US008800329B1

(12) United States Patent
Dolev

(10) Patent No.: US 8,800,329 B1
(45) Date of Patent: Aug. 12, 2014

(54) PROTECTED BAR LOCK ASSEMBLY

(71) Applicant: Moshe Dolev, Udim (IL)

(72) Inventor: Moshe Dolev, Udim (IL)

( * ) Notice: Subject to any disclaimer, the term of this patent is extended or adjusted under 35 U.S.C. 154(b) by 0 days.

(21) Appl. No.: 13/764,904

(22) Filed: Feb. 12, 2013

(51) Int. Cl.
*E05B 67/02* (2006.01)

(52) U.S. Cl.
USPC ..... 70/52; 70/56; 70/36 R; 70/416; 70/417; 70/290

(58) Field of Classification Search
USPC .... 70/2, 38 R, 38 A, 38 B, 38 C, 52–56, 416, 70/417, 286–290
See application file for complete search history.

(56) References Cited

U.S. PATENT DOCUMENTS 4,194,775 A * 3/1980 Shea ..... 292/307 R
4,548,058 A * 10/1985 Bahry et al. ..... 70/56
5,845,520 A * 12/1998 Dolev ..... 70/37
6,609,739 B1 * 8/2003 Avganim ..... 292/295
7,946,142 B2 * 5/2011 Matyko et al. ..... 70/34
7,948,359 B2 * 5/2011 Marcelle et al. ..... 340/5.64
8,020,414 B2 * 9/2011 Pitisethakarn ..... 70/14
2006/0144100 A1 * 7/2006 Thomsen ..... 70/2
2006/0288744 A1 * 12/2006 Smith ..... 70/38 B
2007/0126551 A1 * 6/2007 Slevin ..... 340/5.53
2011/0179833 A1 * 7/2011 Robinson et al. ..... 70/52

* cited by examiner

*Primary Examiner* — Suzanne Barrett
(74) *Attorney, Agent, or Firm* — Dekel Patent Ltd.; David Klein

(57) ABSTRACT

A bar lock assembly including more than one protective hasp member, and a bar lock that locks together the protective hasp members, wherein the bar lock includes a code-operated locking device mounted in a housing that fits into an internal chamber defined by the protective hasp members, the housing including protrusions that are received in inner grooves of the protective hasp members so as to block movement of the protective hasp members away from each other when the housing of the bar lock is inserted into the internal chamber of the protective hasp members.

16 Claims, 12 Drawing Sheets

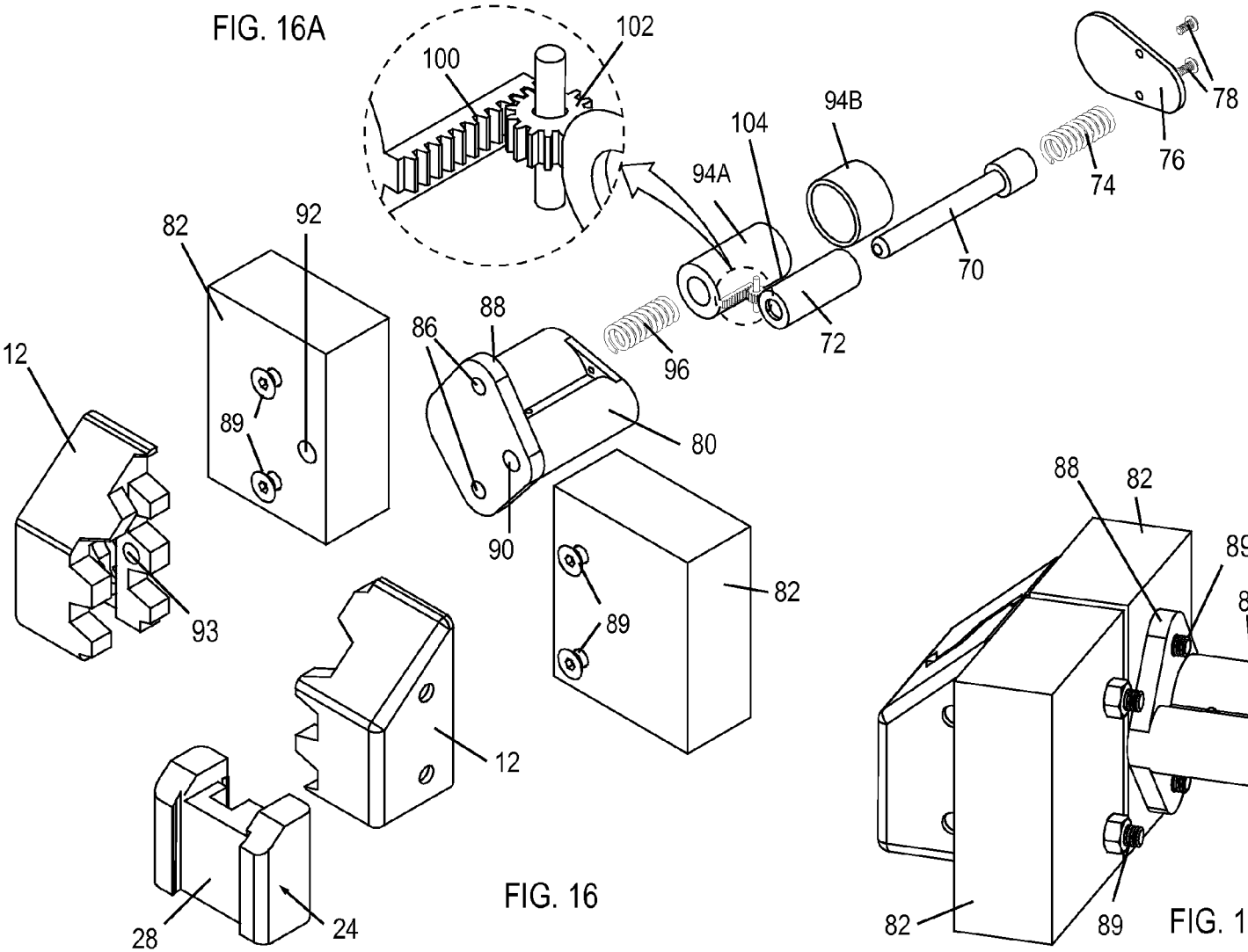
FIG. 16A
FIG. 16
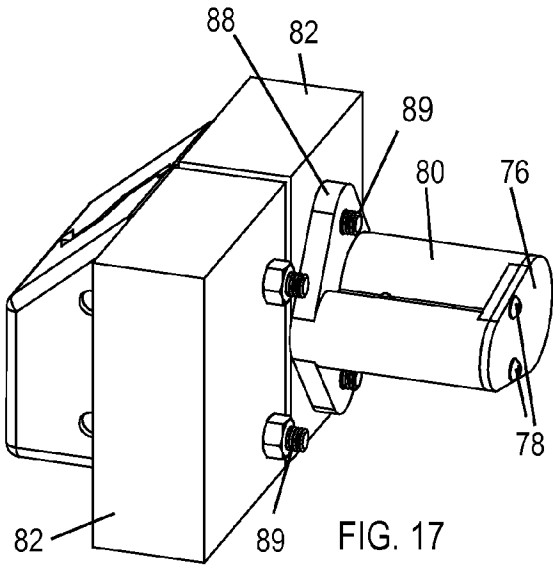
FIG. 17

PROTECTED BAR LOCK ASSEMBLY

FIELD OF THE INVENTION

The present invention relates generally to locks and particularly to a bar lock assembly that has a protected shell with no shackle.

BACKGROUND OF THE INVENTION

Padlocks are commonly used to lock a hasp having a slot through which there is a projecting staple. A prior art padlock typically includes a shackle or bow which fits through the loop of the staple and prevents the staple from removal through the hasp.

However, many shackles can be easily cut using commonly available tools. The traditional defense against this form of attack is to increase the diameter of the shackle legs, thereby increasing the size of the lock body, or by making the shackle from a hardened alloy steel in order to make cutting more difficult. However, this adds significantly to the cost of the padlock. Another problem is that the latching mechanisms and shackles are often vulnerable to wedging, prying, and torsional attack.

U.S. Pat. No. 4,548,058 to Dolev and Bahry describes a padlock, which is shown in FIG. 1. The padlock has two shackle protectors 4, which have intermeshing protrusions 2 and recesses 3. A locking module 5 is inserted into an inner volume of the protectors 4 (as indicated by arrow 1) and legs of a shackle 6 are inserted through an opening 9 of the protectors 4 into holes 7 of locking module 5. It is noted that shackle protectors 4 are locked together only when shackle 6 is locked with locking module 5. The smooth body of locking module 5 does not provide any locking or motion prevention action without shackle 6.

SUMMARY

The present invention seeks to provide a bar lock assembly with improved protection and operation, as is described more in detail hereinbelow.

There is thus provided in accordance with an embodiment of the present invention a bar lock assembly including more than one protective hasp member, and a bar lock that locks together the protective hasp members, wherein the bar lock includes a code-operated locking device and fits into an internal chamber defined by the protective hasp members, the bar lock including protrusions that are received in inner grooves of the protective hasp members so as to block movement of the protective hasp members away from each other when the bar lock is inserted into the internal chamber of the protective hasp members. The protrusions received in the inner grooves block movement of the protective hasp members away from each other, even without locking the bar lock.

In accordance with an embodiment of the present invention, the code-operated locking device includes a rotatable plug to which a locking element is connected, wherein a rotation of the plug moves the locking element into a locked position in which the locking element is in locking engagement with recesses formed in at least one of the protective hasp members so that the bar lock cannot be removed from the protective hasp members, and a different rotation of the plug moves the locking element out of locking engagement with the recesses into an unlocked position so that the bar lock can be removed from the protective hasp members.

In accordance with an embodiment of the present invention, the housing is made of two housing halves which are fastened together with fasteners. The fasteners may serve as the protrusions which are received in the inner grooves.

In accordance with an embodiment of the present invention, the protective hasp members each have an inclined surface, so that a force of a vandalistic blow to the inclined surface is reduced. This significantly reduces the force applied to break or damage the protective hasp members or to detach the protective hasp members from the door or other surface on which they are mounted.

In accordance with an embodiment of the present invention, the locking element rotates when moved from the locked position to the unlocked position. Alternatively, the locking element moves linearly when moved from the locked position to the unlocked position.

In accordance with an embodiment of the present invention, a remote-controlled locking element is movable from a locked position to an unlocked position by means of a remote-controlled actuator.

There is also provided in accordance with an embodiment of the present invention, a bar lock assembly including more than one protective hasp member, a bar lock that fits into an internal chamber defined by the protective hasp members, the bar lock including protrusions that are received in inner grooves of the protective hasp members so as to block movement of the protective hasp members away from each other when the bar lock is inserted into the internal chamber of the protective hasp members, and a remote-controlled locking element manually movable to a locked position with the bar lock and movable to an unlocked position only by means of a remote-controlled actuator. The bar lock assembly is locked simply by snapping or clicking the locking element in place. There is no cylinder lock that needs to be unlocked or locked.

BRIEF DESCRIPTION OF THE DRAWINGS

The present invention will be understood and appreciated more fully from the following detailed description, taken in conjunction with the drawings in which:

FIG. 7 is taken along lines B-B in FIG. 6, wherein FIG. 7 shows a locking element in a locked position in which the protective hasp members are locked together;

FIG. 16 is a simplified exploded illustration of a bar lock assembly, wherein a remote-controlled locking element is used to lock the bar lock together with the protective hasp members, in accordance with an embodiment of the present invention;

FIG. 16A is an enlarged illustration of a gear rack and pinion gear used in the bar lock assembly of FIG. 16;

FIG. 17 is a simplified fully-assembled pictorial illustration of the bar lock assembly of FIG. 16 mounted on a door;

FIG. 19 is taken along lines C-C in FIG. 18, wherein FIG. 19 shows the remote-controlled locking element in a locked position in which the bar lock and the protective hasp members are locked together;

FIG. 20 is a simplified sectional view illustration of the bar lock assembly of FIG. 16, taken along lines D-D in FIG. 18, wherein FIG. 20 shows the remote-controlled locking element in a locked position in which the bar lock and the protective hasp members are locked together;

FIG. 21 is a simplified sectional view illustration of the bar lock assembly of FIG. 16, taken along lines D-D in FIG. 18, wherein FIG. 21 shows the remote-controlled locking element in an unlocked position in which the bar lock can be removed and after which the protective hasp members are free to move relative to one another to open the bar lock assembly;

DETAILED DESCRIPTION

Figure 2:
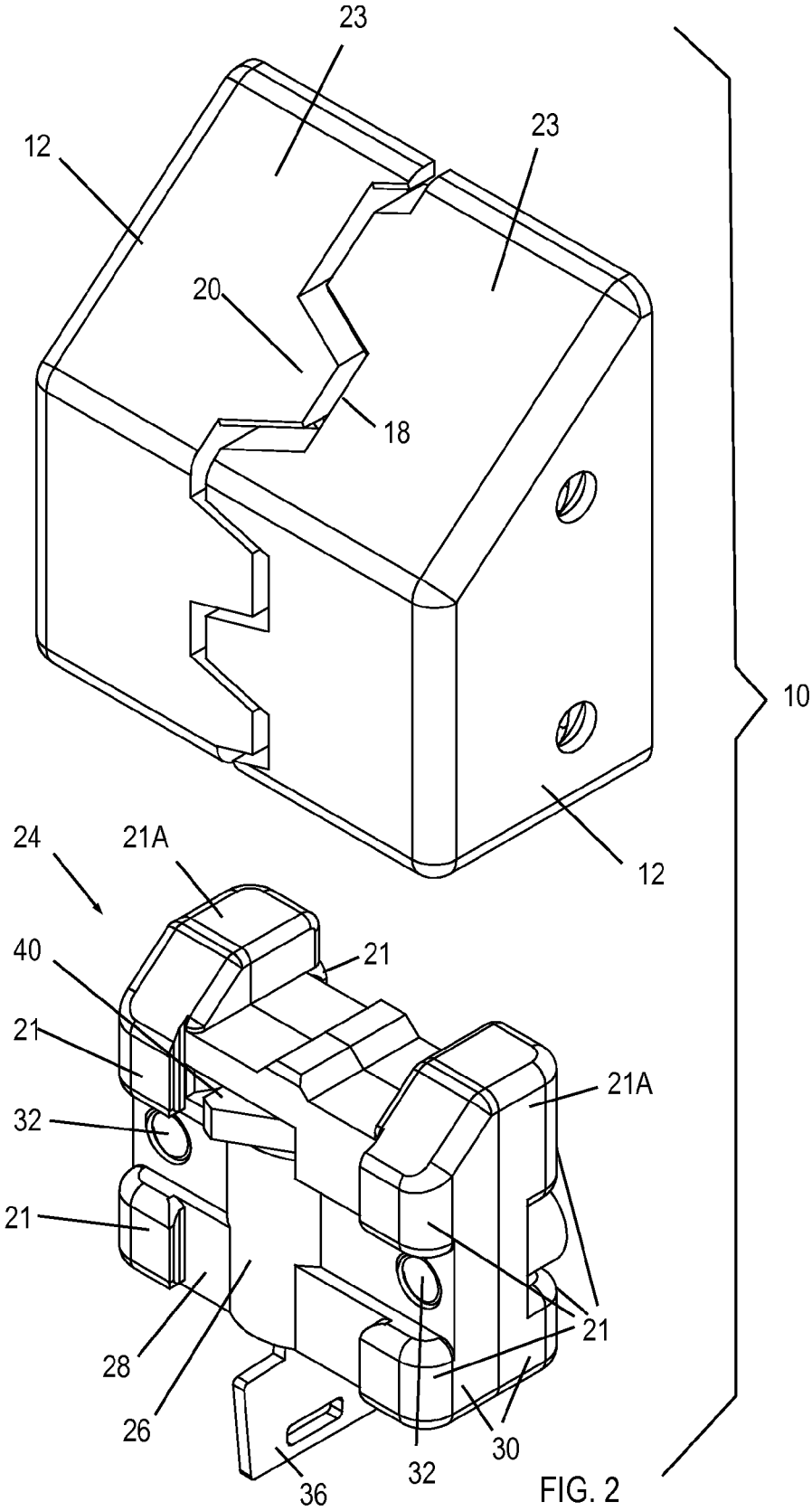
FIG. 2 is a simplified pictorial illustration of a bar lock assembly, constructed and operative in accordance with an embodiment of the present invention, and including a bar lock that locks together two protective hasp members.
Figure 3:
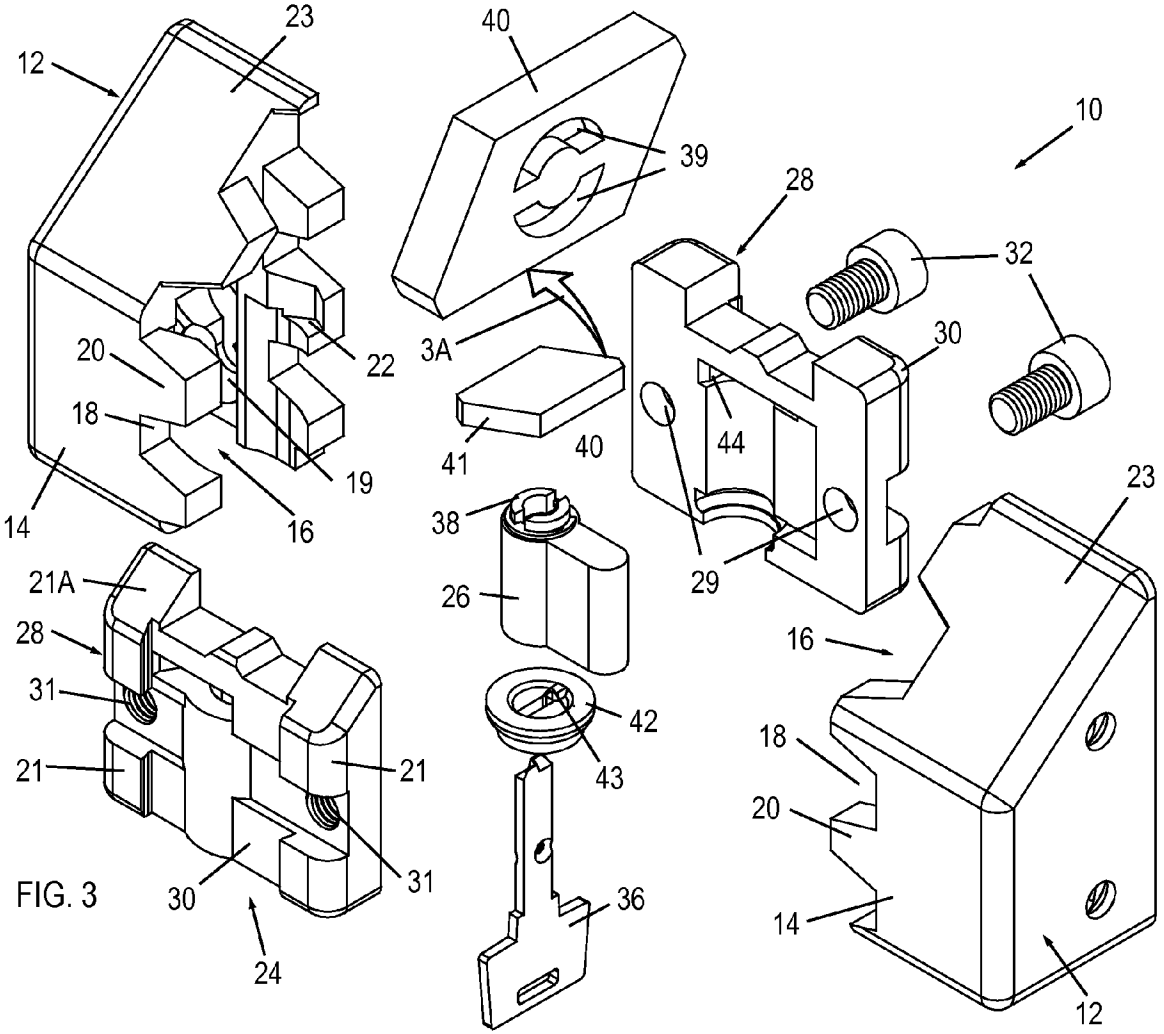
FIG. 3 is a simplified exploded illustration of the bar lock assembly of FIG. 2.
Figure 5:
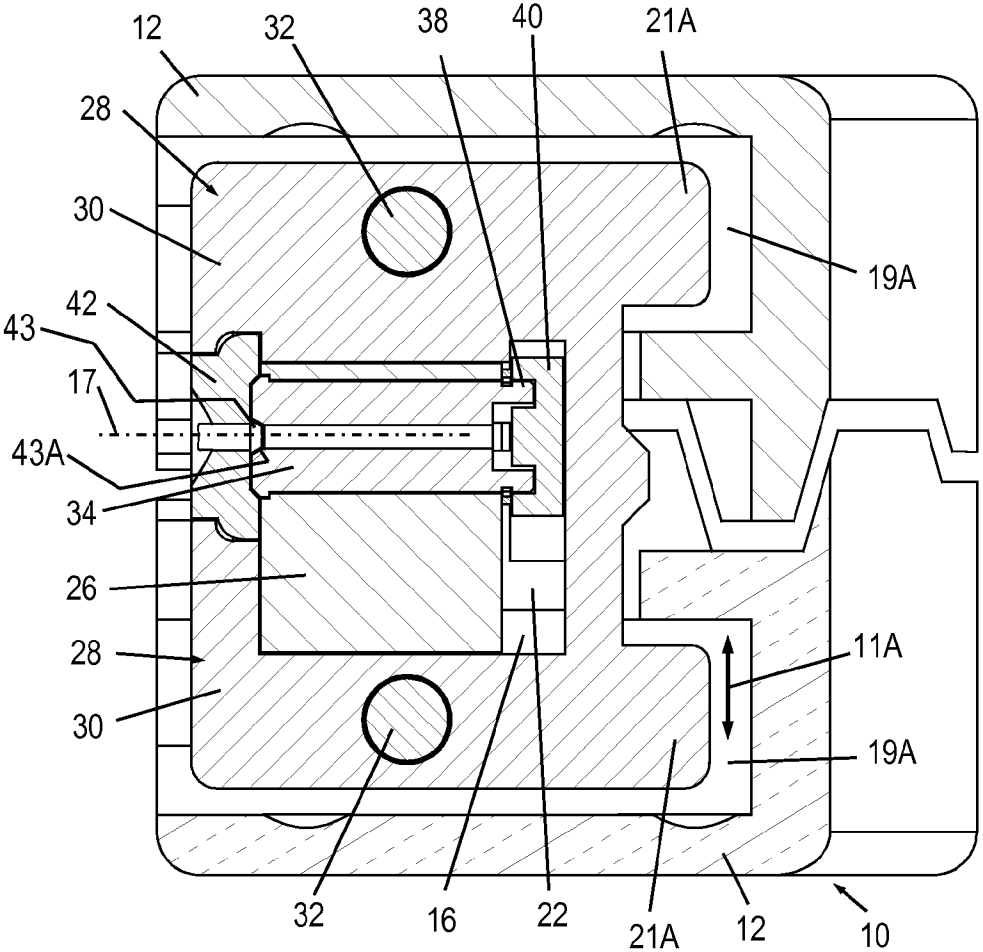
FIGS. 4 and 5 are simplified top-view and sectional view illustrations, respectively, of the bar lock assembly of FIG. 2, FIG. 5 being taken along lines A-A in FIG. 4.
Figure 4:
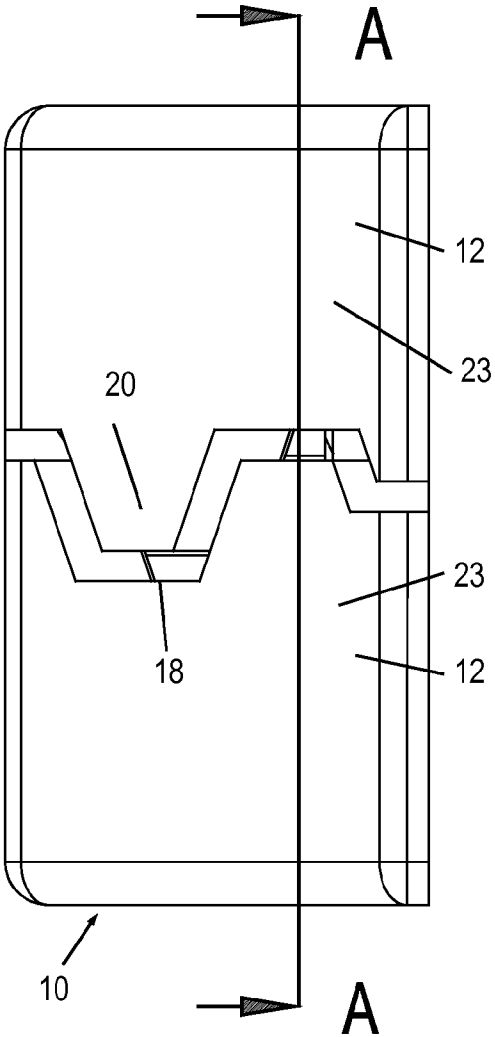

Reference is now made to FIGS. 2 and 3 (most of the elements are shown in FIG. 3 only), and to FIGS. 4 and 5, which illustrate a bar lock assembly 10, constructed and operative in accordance with a non-limiting embodiment of the present invention.

Figure 7:
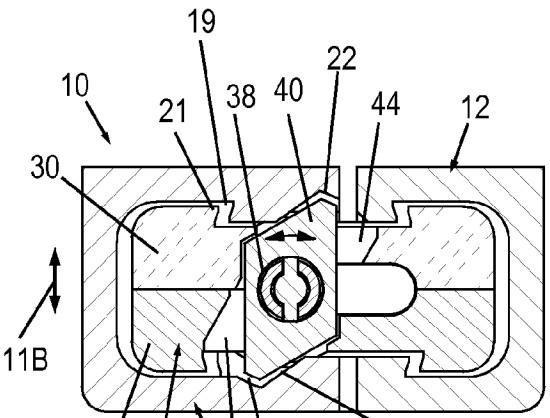
FIGS. 6 and 7 are simplified front-view and sectional view illustrations, respectively, of the bar lock assembly of FIG. 2.

Bar lock assembly 10 includes more than one protective hasp member 12. In the illustrated embodiment there are two protective hasp members 12. Each protective hasp member 12 includes a pair of wall extensions 14 separated by a gap 16 (also called internal chamber 16). Wall extensions 14 are preferably, but not necessarily, formed with a plurality of intermeshing mortises 18 and tenons 20 positioned such that the tenons 20 of one of the shell members 12 fit into the mortises 18 of the other shell member 12. Each protective hasp member 12 is formed with an inner groove 19 (FIG. 7). One or both of wall extensions 14 may be formed with a locking element recess 22 for receiving therein a locking element in a locked position, as will be described further below (that is, the locking element may be received in one side only [FIG. 9] or in both sides [FIG. 7]).

Unlike the prior art padlock of U.S. Pat. No. 4,548,058, protective hasp members 12 each have an inclined (upper) surface 23, which preferably has no opening. Inclined surface 23 adds to the security of bar lock assembly 10, because the force of any vandalistic blow to inclined surface 23 is divided into two vector components, one of which is wasted energy. The remaining vectorial force is much less than the applied force. This significantly reduces the force applied to break or damage the protective hasp members or to detach the protective hasp members from the door or other surface on which they are mounted.

Bar lock assembly 10 includes a bar lock 24, which includes a code-operated locking device 26 mounted in a housing 28. The code-operated locking device 26 in the illustrated embodiment is a cylinder lock 26, and will be referred to in the description as cylinder lock 26. However, it is noted that the invention is not limited to cylinder locks; code-operated locking device 26 may be any kind of mechanically key-operated device (the code being the key cuts in the key), electromechanical locking device, as well as locking devices with no key, such as devices operated by means of inputting a code, or electronic devices, remote-controlled devices and many others.

Housing 28 may be made of two housing halves 30 which are fastened together with fasteners 32, such as bolts that fit through holes 29 (formed in one of the housing halves 30) and which screw into tapped holes 31 (formed in the other housing half 30). Housing 28 has a plurality of protrusions, such as protrusions 21 formed on the left and/or right sides of housing 28 (front and/or back), which are received in inner grooves 19 (FIGS. 3 and 7) of protective hasp member 12. In another embodiment, the fasteners 32 may serve additionally or alternatively as the protrusions which are received in inner grooves 19. Housing 28 may also include upper protrusions 21A, which are received in internal crevices 19A (FIG. 5) of the inclined surface 23. "Grooves", "notches", "channels" and "crevices" are used interchangeably.

Housing 28 fits into an internal chamber defined by the gaps 16 of protective hasp members 12. In contrast to the prior art padlock of U.S. Pat. No. 454805, just by inserting bar lock 24 (housing 28 of bar lock 24) into protective hasp members 12 without any locking of bar lock 24, the protective hasp members 12 cannot be moved away from each other, including left-right directions (arrows 11A in FIG. 5), and inward-outward directions (arrows 11B in FIG. 7). More specifically, as seen in FIG. 5, any left-right movement of members 12 away from each other is blocked by upper protrusions 21A received in internal crevices 19A (and also by front and rear protrusions 21 received in inner grooves 19, not seen in FIG. 5, but shown and indicated by arrow 11A in FIG. 7). As seen in FIG. 7, any inward-outward movement of members 12 away from each other is blocked by the housing halves 30 abutting against the inner walls of protective hasp members 12. The mortises 18 and tenons 20 prevent protective hasp members 12 from being moved away from each other in the up-down directions, and are useful in preventing a vandal from lifting doors to which bar lock assembly 10 is mounted vertically out of their moorings.

Bar lock 24 is locked to the protective hasp members 12 in order to prevent bar lock 24 from slipping out, as is now explained.

Cylinder lock 26 is shown as having a Euro-profile, but the invention is not limited to this shape. Cylinder lock 26 has a rotatable plug 34 (seen in FIGS. 3 and 5) operable by a key 36. Plug 34 terminates in, or is attached to, a locking-element connector 38, such as a pair of partial-circle protrusions, which are received in complementarily-shaped partial-circle notches 39 formed in a locking element 40. (Notches 39 are seen in the underside of locking element 40, which is shown in an enlargement to which the arrow 3A in FIG. 3 points). Cylinder lock 26 may be protected with a round disc 42, made of a tamper-resistant metal, which helps prevent drilling or other violent attack on the cylinder lock 26. Protector 42 may be provided with a tab 43 that mates with a recess 43A (FIG. 5) in the cylinder lock 26, so as to prevent protector 42 from freely rotating. (However, if a vandalistic force is applied, such as to gain drilling access to the cylinder lock, the tab 43 will wear out the recess 43A so that protector 42 will freely rotate, thereby defeating drilling attempts.) Locking element 40 is arranged for moving in and out of an aperture 44 formed in housing 28 (aperture 44 is formed in one or more of housing halves 30, and may have a somewhat rectangular shape, but are not limited to this shape).

Figure 8:
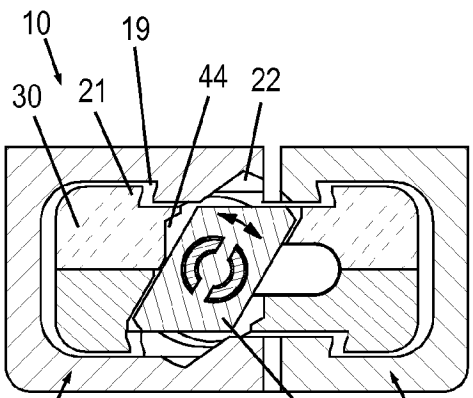
FIG. 8 is a simplified sectional view illustration, corresponding to FIG. 7, wherein the locking element has been moved to an unlocked position in which the bar lock is removable and the protective hasp members are free to move relative to one another to open the bar lock assembly.
Figure 6:
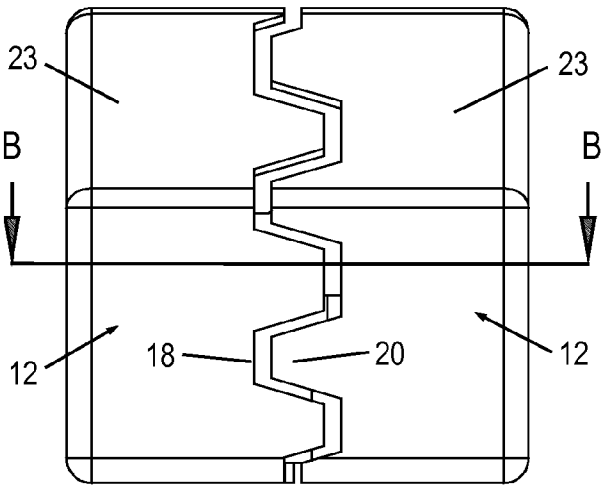

Reference is now made to FIGS. 6-8. FIG. 7 shows locking element 40 in a locked position in which bar lock 24 and the protective hasp members 12 are locked together. Locking element 40 protrudes out of aperture 44 and is received in locking element recess 22. In other words, locking element 40 is in locking engagement with recesses 22 formed in at least one of the protective hasp members 12 so that bar lock 24 cannot fall out of bar lock assembly 10. Protective hasp members 12 overlap locking element 40, so as to protect locking element 40 from tampering.

In accordance with an embodiment of the present invention, as seen in FIG. 5, the length of the chamber formed by gaps 16 extends along a longitudinal axis 17. In the locked position, locking element 40 extends into protective hasp members 12 non-parallel (e.g., perpendicular) to the longitudinal axis 17.

In accordance with an embodiment of the present invention, as seen in FIGS. 3 and 7, locking element 40 has at least one sloped side 41 (e.g., two sloped sides 41), which in the locked position, abuts against complementary-shaped sloped recess 22 in at least one of the protective hasp members 12. If there were no sloped side, locking element 40 would have to be rotated 90° or more in order to completely retract locking element 40 so that it does not interfere with removal of bar lock 24 from protective hasp members 12. By providing sloped side 41, locking element 40 can be rotated less than 90° in order to completely retract locking element 40 so that it does not interfere with removal of bar lock 24 from protective hasp members 12. Thus, sloped side 41 is provided for convenience so that the user only has to rotate locking element 40 a little bit.

In FIG. 8, the plug has been rotated by the key (all not shown in FIG. 8), so that locking element 40 has been moved (rotated) to an unlocked position (locking element 40 has been retracted into apertures 44 so it does not protrude anymore into recesses 22) and bar lock 24 can be removed from protective hasp members 12.

Figure 9:
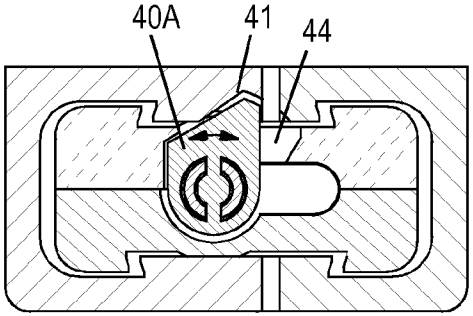
FIG. 9 is a simplified sectional view illustration, corresponding to FIG. 7, showing a different type of locking element in the locked position, in accordance with an embodiment of the present invention.

Reference is now made to FIG. 9, which illustrates a different type of locking element 40A in the locked position, in accordance with an embodiment of the present invention. Locking element 40A has only one sloped surface 41, but operates basically the same as locking element 40 described above.

Figure 10:
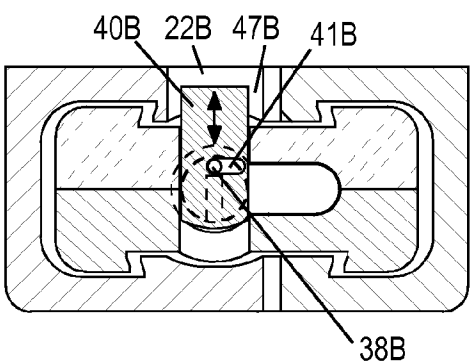
FIG. 10 is a simplified sectional view illustration, corresponding to FIG. 7, showing yet another type of locking element in the locked position, in accordance with an embodiment of the present invention.

Reference is now made to FIG. 10, which illustrates yet another type of locking element 40B in the locked position, in accordance with an embodiment of the present invention. In this embodiment, locking element 40B is constrained to move linearly (as opposed to the rotating locking elements 40 and 40A) in a channel 47B. Locking element 40B moves linearly in and out of recess 22B by the rotating action of a locking-element connector 38B, which is a pin or similar element that pushes against an inner groove 41B of locking element 40B.

Figure 11:
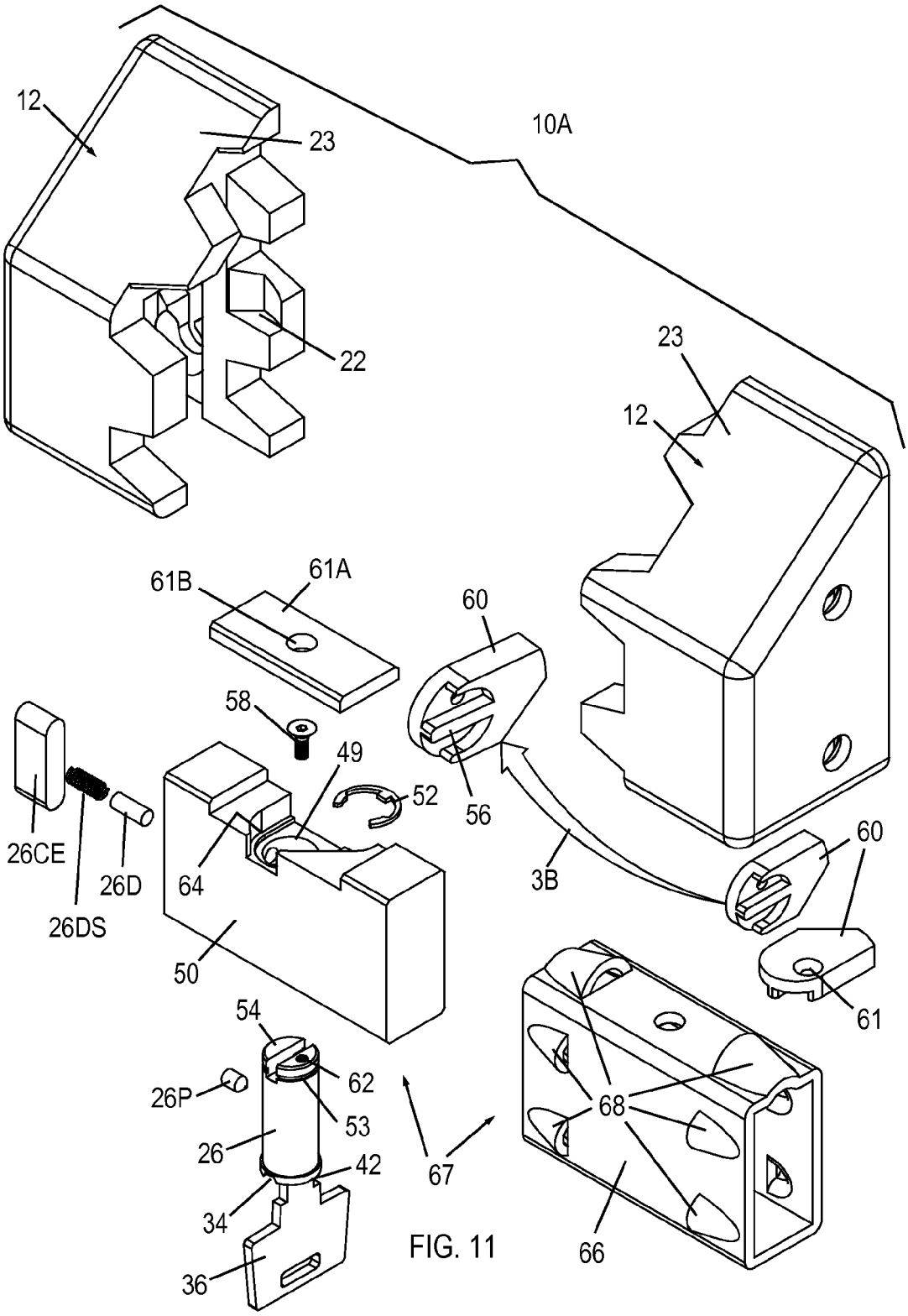
FIG. 11 is a simplified exploded illustration of a bar lock assembly, constructed and operative in accordance with another embodiment of the present invention.
Figure 13:
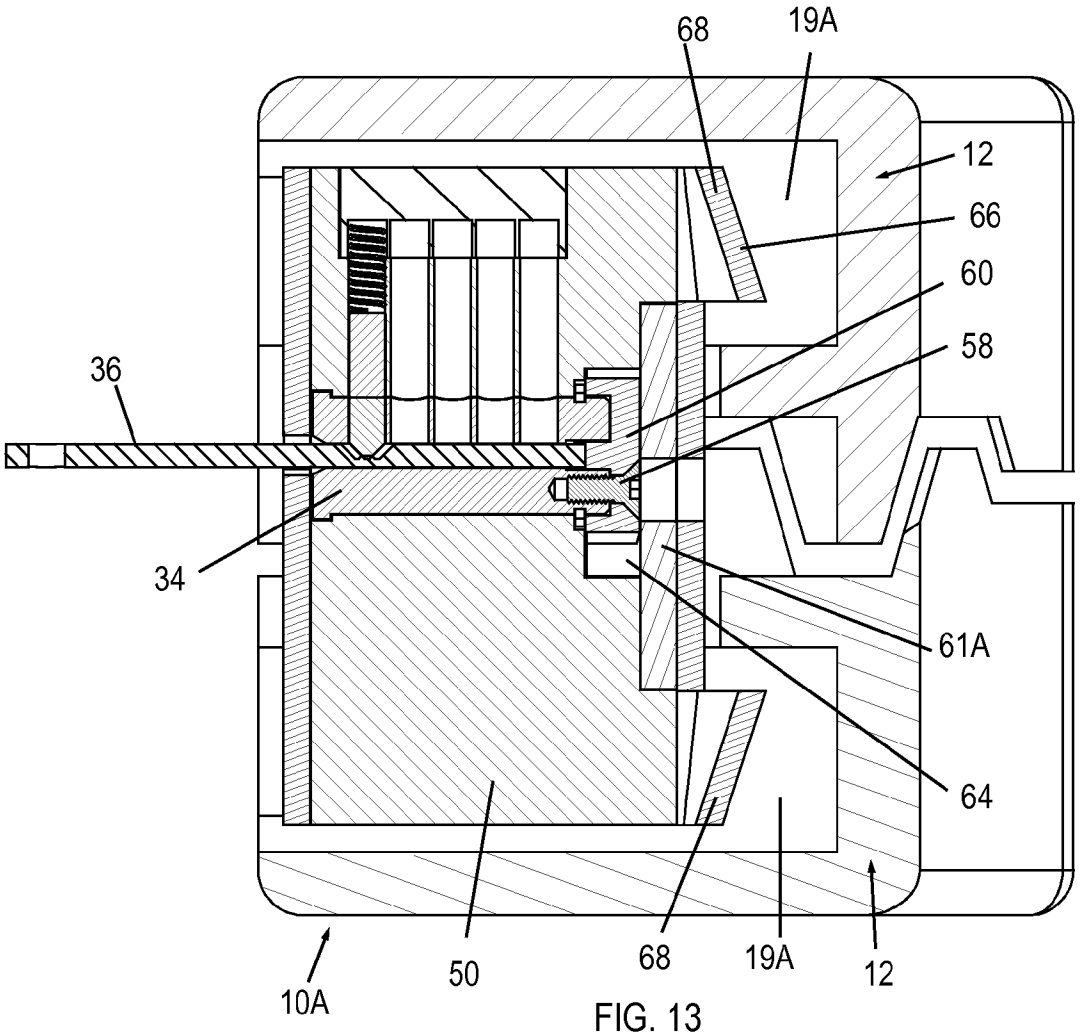
FIGS. 12 and 13 are simplified top-view and sectional view illustrations, respectively, of the bar lock assembly of FIG. 11, FIG. 13 being taken along lines F-F in FIG. 12.
Figure 12:
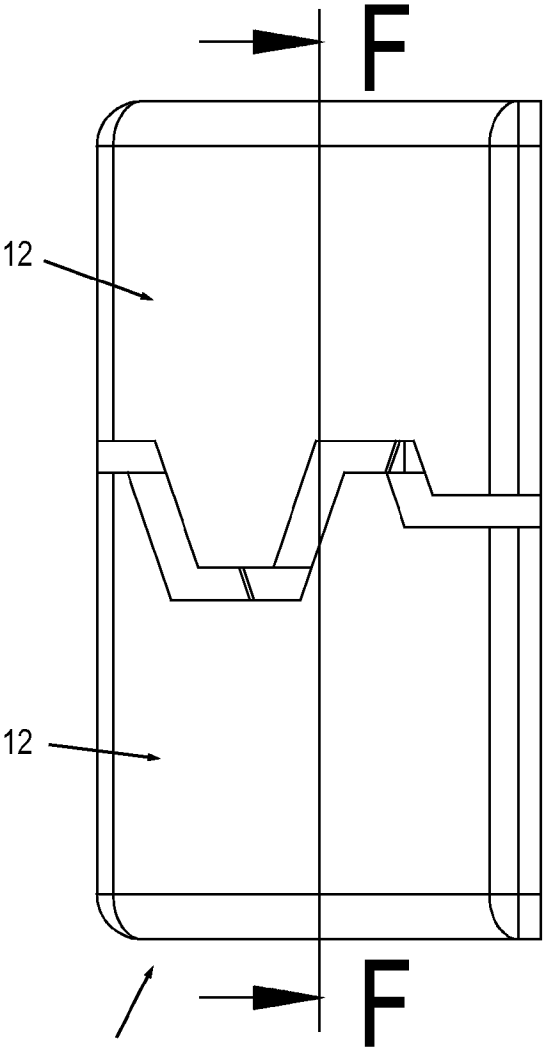
Figure 15:
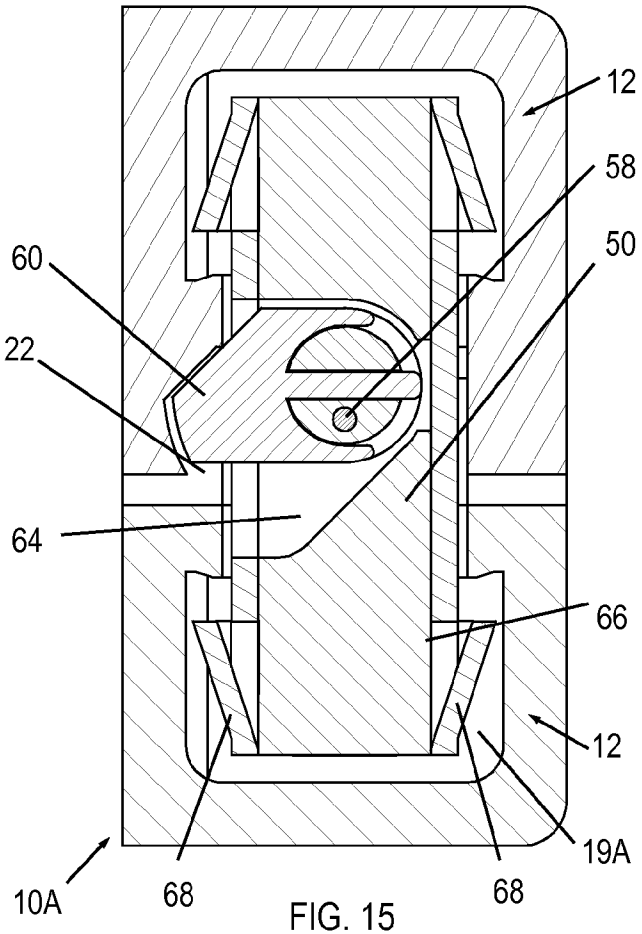
FIGS. 14 and 15 are simplified front-view and sectional view illustrations, respectively, of the bar lock assembly of FIG. 11, FIG. 15 being taken along lines G-G in FIG. 14.
Figure 14:
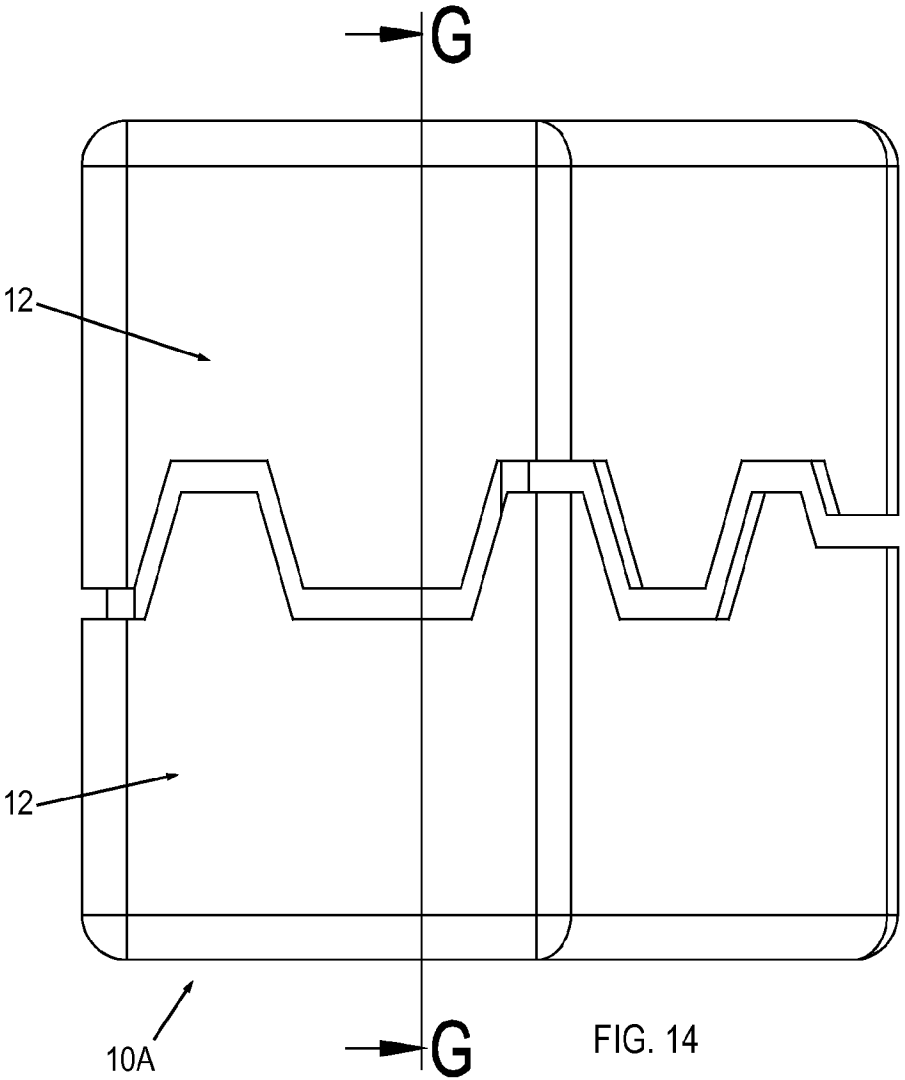

Reference is now made to FIGS. 11-15, which illustrate a bar lock assembly 10A, constructed and operative in accordance with a non-limiting embodiment of the present invention. (All elements are shown in FIG. 11.)

Bar lock assembly 10A has some similar parts to bar lock assembly 10, which are designated by identical reference numerals. Bar lock assembly 10A differs from bar lock assembly 10 in the type of housing for the bar lock and in the type of locking element, as will now be explained.

Figure 1:
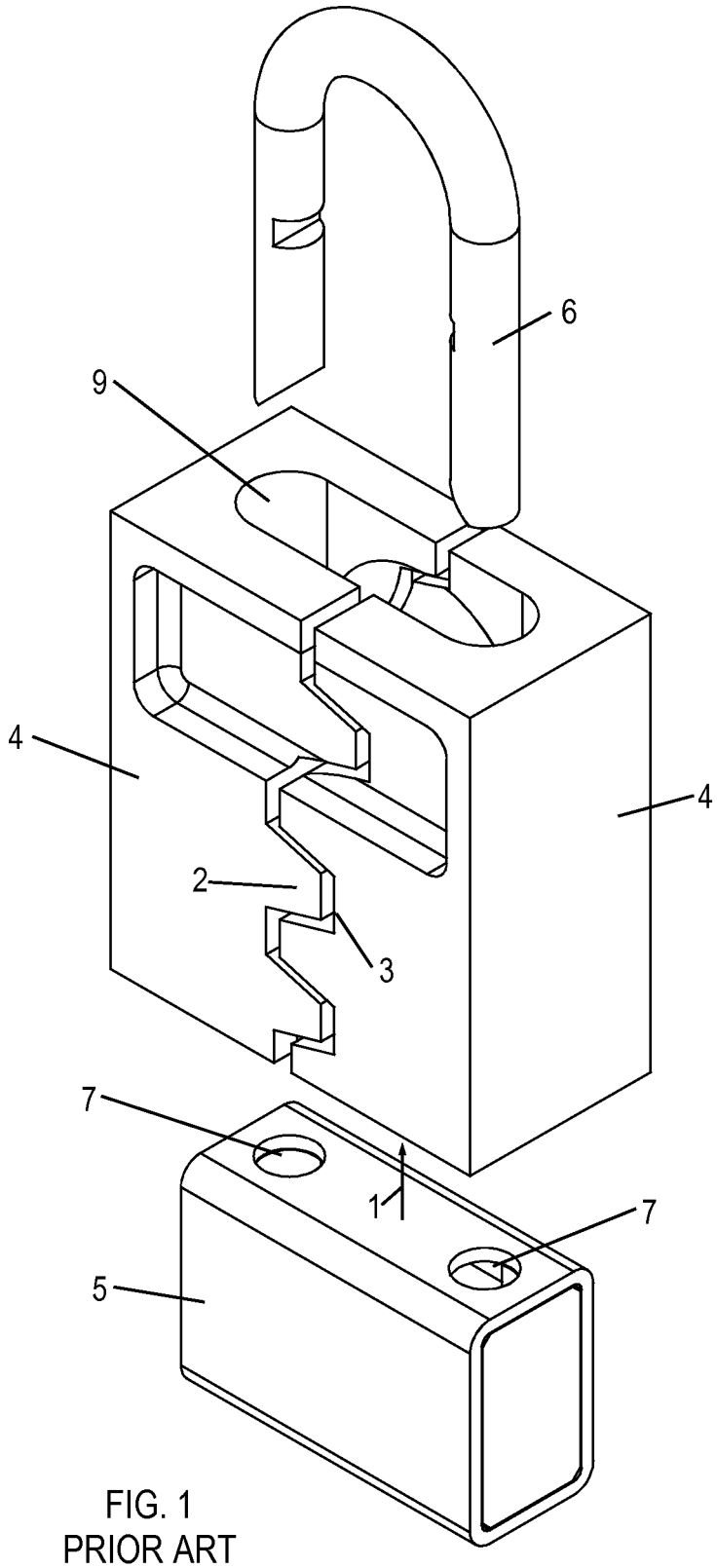
FIG. 1 PRIOR ART
FIG. 1 is a simplified pictorial illustration of a prior art padlock of U.S. Pat. No. 4,548,058.

In bar lock assembly 10A, cylinder lock 26 is inserted in a bore 49 of a housing 50, which may be constructed like locking module 5 of U.S. Pat. No. 4,548,058 (FIG. 1). One of the plug pins 26P of cylinder lock 26 is shown in FIG. 11, as well as one of the driver pins 26D with a driver spring 26DS and closure element 26CE. An end of the cylinder lock 26 may be secured with a circlips 52 that fits into a groove 53 in cylinder lock 26. Plug 34 terminates in, or is attached to, a locking-element connector 54, such as a pair of D-shaped protrusions, which are received in complementarily-shaped cutouts 56 formed in a locking element 60. (Cutouts 56 are seen in the underside of locking element 60, which is shown in an enlargement to which the arrow 3B in FIG. 11 points). A fastener 58 may be used to secure locking element 60 to locking-element connector 54. Fastener 58 may pass through a hole 61 in locking element 60 and screw into a tapped hole 62 in locking-element connector 54. Locking element 60 is arranged to move in and out of aperture 64 formed in housing 50 to go in and out of locking engagement with locking element recesses 22 formed in protective hasp members 12. A small plate 61A overlies locking element 60 and has a hole 61B for fastener 58 to completely pass through.

In contrast to U.S. Pat. No. 4,548,058, housing 50 is received in an open-ended casing 66, which is formed with protrusions 68, which may be punched or otherwise formed out of casing 66. The assembly of housing 50 in casing 66 forms a bar lock 67. As described above for bar lock assembly 10, just by inserting bar lock 67 into protective hasp members 12 without any locking of bar lock 67, the protective hasp members 12 cannot be moved away from each other, because such movement is blocked by protrusions 68 in internal grooves 19 and crevices 19A of members 12 (FIGS. 13 and 15) (the mating tenons and mortises of protective hasp members 12 prevent up-and-down movement as explained above).

Reference is now made to FIGS. 16-23, which illustrate a version of the bar lock assembly 10 of FIG. 1, wherein a remote-controlled locking element is used to lock the protective hasp members together with the bar lock, in accordance with an embodiment of the present invention. Such an embodiment is useful for situations which require a multitude of locks, for example, for locking public shelters, which must be opened rapidly and virtually simultaneously in times of emergencies. By providing the possibility of remote actuation, the present invention answers such a need and permits simultaneously opening a multiplicity of locks by remote actuation from a command post, for example.

It is noted that the figures illustrate just one possible embodiment of a remote-controlled locking element, and the invention is not limited to this embodiment.

In the illustrated embodiment, a remote-controlled locking element 70 is a spring-loaded plunger (elongate pin or rod, for example), which is disposed in a bushing 72 and is urged by a biasing device 74, such as a coil spring. One end of biasing device 74 is placed against a head of element 70 and the other end abuts against an end plate 76. End plate 76 is secured by fasteners 78 to a remote-control housing 80. Housing 80 is secured to one of two building structures 82, such as by two fasteners 89 which pass through mounting holes 86 formed in a flange 88 of housing 80. The building structures 82 may be a pair of doors (e.g., hinged or sliding doors), or a door and a door post, or a door and a wall, for example. The protective hasp members 12 are attached to building structures 82 by fasteners 89. The remote-controlled locking element 70 passes through bushing 72, an opening 90 in housing 80 and another opening 92 in one of the building structures 82 and finally into and through an opening 93 in one of the protective hasp members 12 (FIG. 16).

Figure 21:
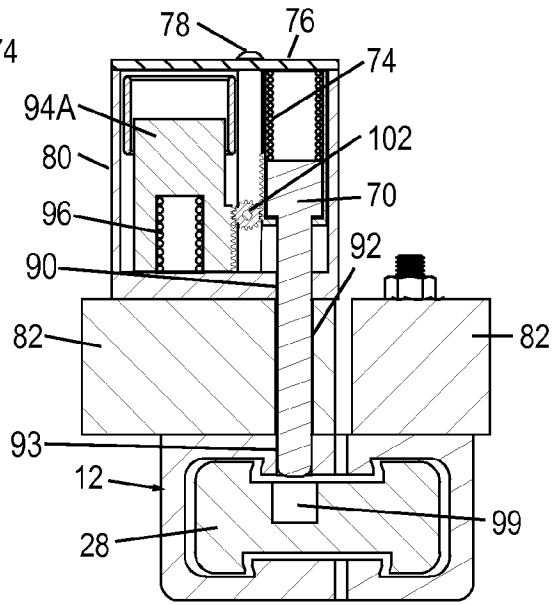
Figure 20A:
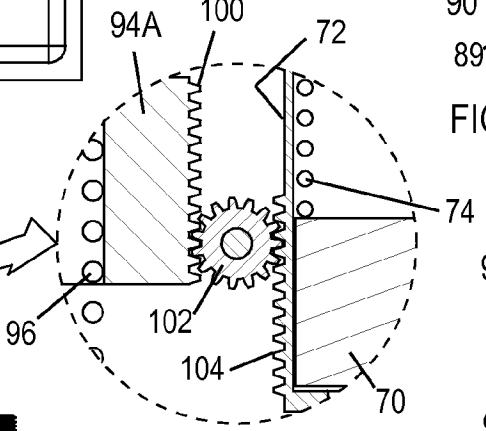
FIG. 20A is a more detailed illustration of an actuator used to move the remote-controlled locking element from the locked position to the unlocked position.
Figure 18:
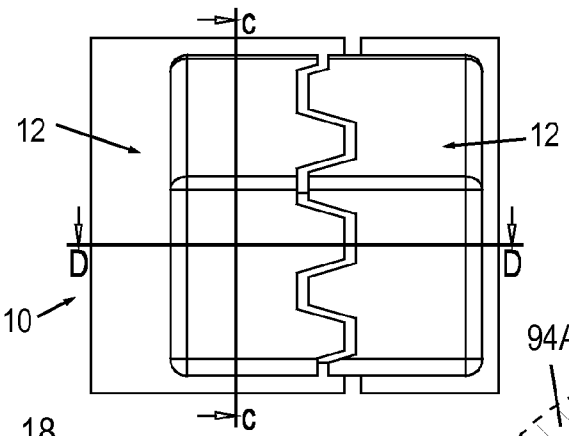
Figure 20:
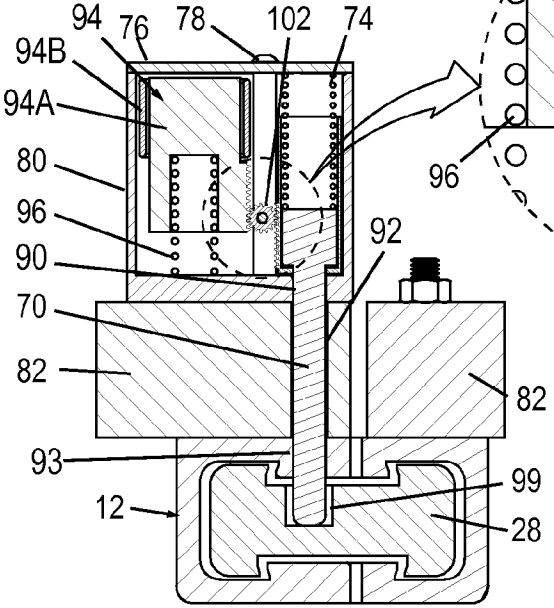

Remote-controlled locking element 70 is movable from the locked position to the unlocked position by means of a remote-controlled actuator 94, such as but not limited to, a solenoid which includes a solenoid core (also called armature) 94A and solenoid coil 94B. Actuator 94 can be actuated by a wireless device, a cell phone, over the Internet, etc. In the illustrated embodiment, actuator 94 is housed in housing 80 and core 94A is biased by a biasing device 96, such as a coil spring, as seen in FIGS. 20 and 21. As seen in FIG. 20A, core 94A includes a gear rack 100 which meshes with a pinion gear 102, which in turn meshes with a gear rack 104 of bushing 72.

Figure 19:
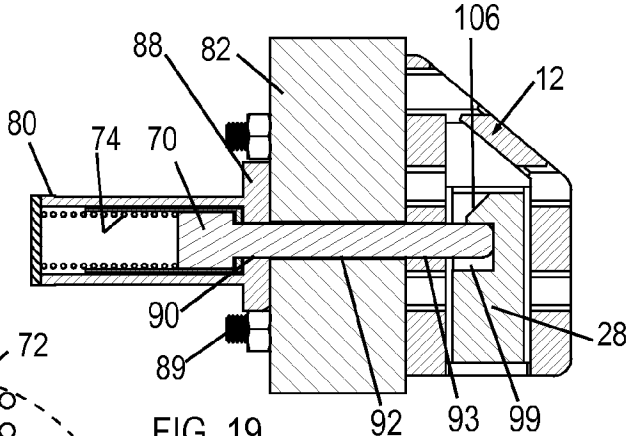
FIGS. 18 and 19 are simplified front-view and sectional view illustrations, respectively, of the bar lock assembly of FIG. 16.
Figure 23:
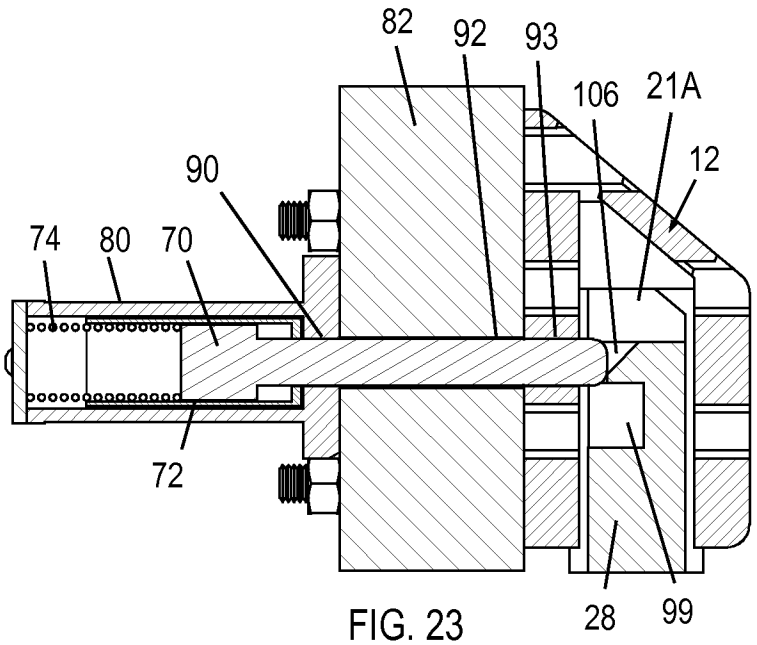
FIG. 23 is a simplified sectional view illustration of the bar lock assembly of FIG. 16, taken along lines C-C in FIG. 18, showing a chamfered portion of the bar lock pushing against a spring-loaded plunger (the remote-controlled locking element), just prior to the plunger snapping into an aperture in which it is in the locked position.
Figure 22:
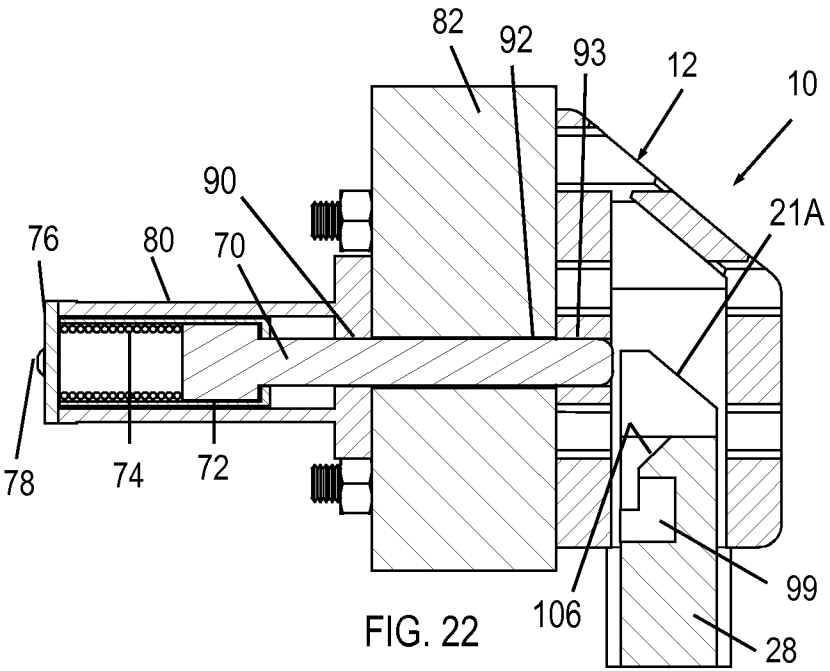
FIG. 22 is a simplified sectional view illustration of the bar lock assembly of FIG. 16, taken along lines C-C in FIG. 18, showing the unlocked position.

In the locked position seen in FIGS. 19 and 20, remote-controlled locking element 70 extends into protective hasp member 12 and into an aperture 99 in housing 28 of bar lock 24. In the locked position, both biasing devices 74 and 96 are not compressed. As seen in FIG. 20, core 94A of actuator 94 is positioned close to end plate 76. In the unlocked position seen in FIGS. 21 and 22, actuator 94 moves away from end plate 76 (FIG. 21), thereby causing pinion gear 102 to rotate, which retracts remote-controlled locking element 70 out of housing 28 of bar lock 24. In FIG. 22, housing 28 is being removed from bar lock assembly 10. FIG. 23 shows housing 28 being re-inserted into bar lock assembly 10. It is seen that housing 28 of the bar lock has a chamfered portion 106 that permits locking element 70 to smoothly move into aperture 99. The chamfered portion 106 pushes against the spring-loaded plunger (remote-controlled locking element) 70, and right afterwards, element 70 snaps into aperture 99 to be in the locked position. Thus, remote-controlled locking element 70 locks by clicking in place, and no authorization is required to lock the bar lock assembly.

In the embodiment of FIGS. 16-23, the bar lock 24 has no code-operated locking device, which reduces costs.

Figure 24:
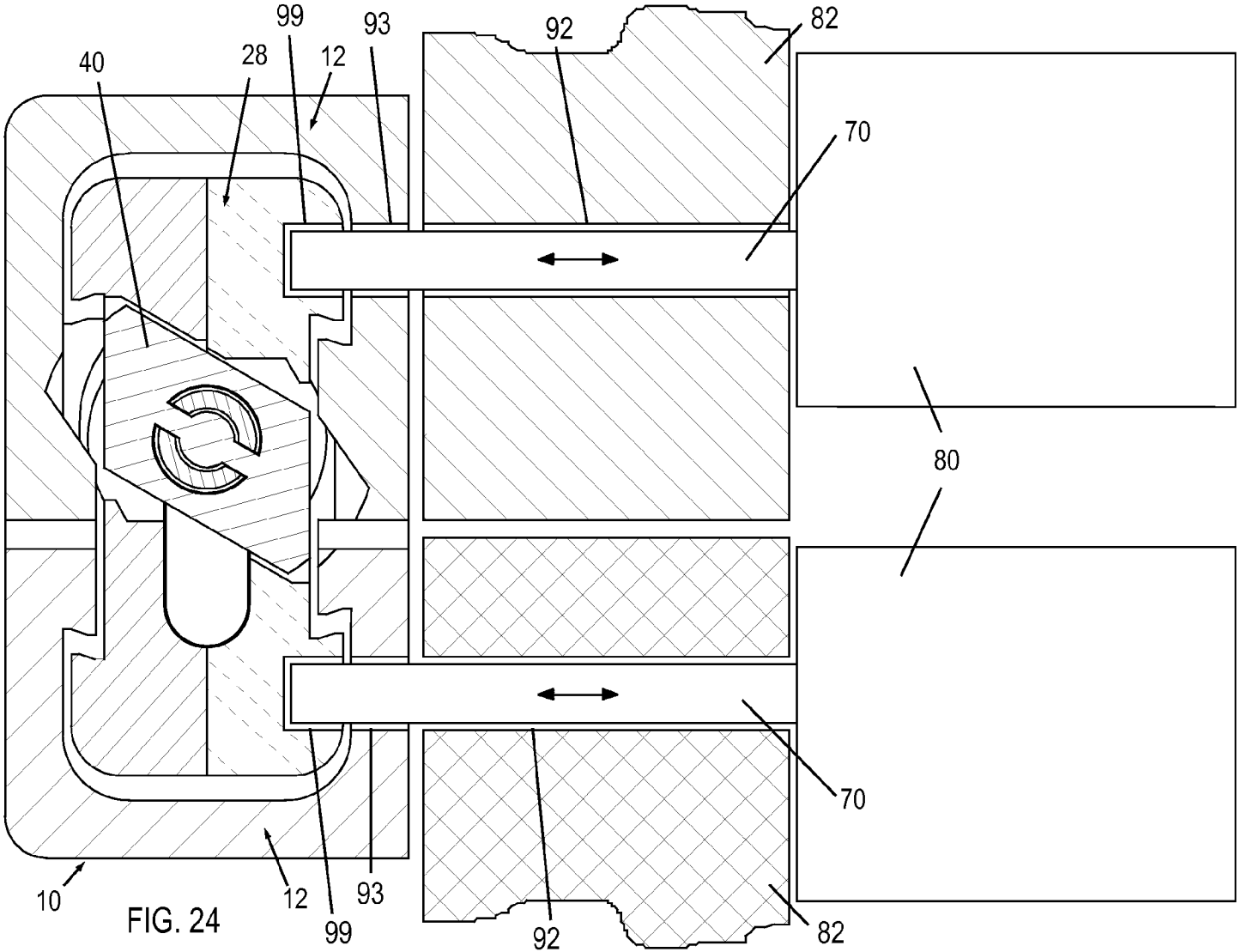
FIG. 24 is a simplified partially sectional illustration of a version of the bar lock assembly of FIG. 2, wherein two remote-controlled locking elements are used to lock the protective hasp members together, in accordance with an embodiment of the present invention, in addition to the locking mechanism of FIG. 2.

Reference is now made to FIG. 24, which illustrates a version of the bar lock assembly, wherein a pair of remote-controlled locking elements 70 are used to lock the protective hasp members 12 together, in addition to the locking mechanism of FIG. 2. This embodiment may be useful in a situation which requires several people to open the bar lock assembly: one person to open the locking mechanism (such as with a key), and a second person to open the remote-controlled locking elements 70 or a second person to open one of the remote-controlled locking elements 70 and a third person to open the other one of the remote-controlled locking elements 70.

In all of the embodiments of the remote-controlled bar lock assembly, the remote-controlled portion is located inside a protected area in the inside of a building, room, warehouse, trailer, container, etc., so it is protected from the weather and environment. In addition, placing the remote-controlled portion inside a protected area permits using simple, inexpensive batteries, located in the protected area, to power the assembly and the batteries are no limited to any size or shape. Alternatively, if possible, the assembly may be powered by an electric grid and a battery backup. Housing 80 may include electronics for monitoring opening and closing of the lock assembly, its global position, tampering attempts and the like or any combination thereof, wherein the electronics are also located in the protected area.

It will be appreciated by persons skilled in the art that the present invention is not limited by what has been particularly shown and described hereinabove. Rather the scope of the present invention includes both combinations and subcombinations of the features described hereinabove as well as modifications and variations thereof which would occur to a person of skill in the art upon reading the foregoing description and which are not in the prior art.

What is claimed is:

1. A bar lock assembly comprising:

more than one protective hasp member; and a bar lock that locks together said protective hasp members, wherein said bar lock comprises a code-operated locking device mounted in a housing that fits into an internal chamber defined by said protective hasp members, said housing comprising protrusions that are received in inner grooves of said protective hasp members so as to block movement of said protective hasp members away from each other when said housing of said bar lock is inserted into said internal chamber of said protective hasp members.

2. The bar lock assembly according to claim 1, wherein said protrusions received in said inner grooves block movement of said protective hasp members away from each other, even without locking said bar lock.

3. The bar lock assembly according to claim 1, wherein said code-operated locking device comprises a rotatable plug to which a locking element is connected, wherein a rotation of said plug moves said locking element into a locked position in which said locking element is in locking engagement with recesses formed in at least one of said protective hasp members so that said bar lock cannot be removed from said protective hasp members, and a different rotation of said plug moves said locking element out of locking engagement with said recesses into an unlocked position so that said bar lock can be removed from said protective hasp members.

4. The bar lock assembly according to claim 1, wherein said housing is made of two housing halves which are fastened together with fasteners.

5. The bar lock assembly according to claim 4, wherein said fasteners serve as said protrusions which are received in said inner grooves.

6. The bar lock assembly according to claim 1, wherein said protective hasp members each have an inclined surface, so that a force of a vandalistic blow to said inclined surface is reduced.

7. The bar lock assembly according to claim 3, wherein a length of said chamber extends along a longitudinal axis and in said locked position said locking element extends into said protective hasp members non-parallel to said longitudinal axis.

8. The bar lock assembly according to claim 3, wherein said locking element rotates when moved from the locked position to the unlocked position.

9. The bar lock assembly according to claim 3, wherein said locking element moves linearly when moved from the locked position to the unlocked position.

10. The bar lock assembly according to claim 1, further comprising a remote-controlled locking element movable from a locked position to an unlocked position by means of a remote-controlled actuator.

11. A bar lock assembly comprising:

more than one protective hasp member;

a bar lock that fits into an internal chamber defined by said protective hasp members, said bar lock comprising protrusions that are received in inner grooves of said protective hasp members so as to block movement of said protective hasp members away from each other when said bar lock is inserted into said internal chamber of said protective hasp members; and a remote-controlled locking element manually movable to a locked position with said bar lock and movable to an unlocked position only by means of a remote-controlled actuator.

12. The bar lock assembly according to claim 11, wherein said remote-controlled locking element snaps into the locked position.

13. The bar lock assembly according to claim 11, wherein said remote-controlled locking element is located inside a protected area.

14. The bar lock assembly according to claim 11, wherein said remote-controlled locking element is powered by a battery located in said protected area.

15. The bar lock assembly according to claim 11, wherein said remote-controlled locking element is powered by an electric grid and a battery backup.

16. The bar lock assembly according to claim 11, comprising electronics for monitoring opening and closing of the lock assembly, its global position, tampering attempts or any combination thereof.

* * * * *